US012590756B1

(12) United States Patent
SamuelsBey

(10) Patent No.: US 12,590,756 B1
(45) Date of Patent: Mar. 31, 2026

(54) D.F.R. DEEP FREEZER RACK

(71) Applicant: Thomas Prentiss SamuelsBey, Philadelphia, PA (US)

(72) Inventor: Thomas Prentiss SamuelsBey, Philadelphia, PA (US)

( * ) Notice: Subject to any disclaimer, the term of this patent is extended or adjusted under 35 U.S.C. 154(b) by 121 days.

(21) Appl. No.: 18/219,225

(22) Filed: Jul. 7, 2023

(51) Int. Cl.
*F25D 25/02* (2006.01)

(52) U.S. Cl.
CPC ..... *F25D 25/02* (2013.01)

(58) Field of Classification Search
CPC ... F25D 2325/023; F25D 23/067; F25D 25/02
See application file for complete search history.

(56) References Cited

U.S. PATENT DOCUMENTS 3,052,508 A * 9/1962 Fink ..... F25D 13/02 312/404
3,083,836 A * 4/1963 Bussemer ..... F25D 2325/023 211/134
5,626,407 A 5/1997 Westcott
6,932,449 B2 8/2005 Collins
8,746,818 B2 * 6/2014 Meese ..... F25D 23/04 312/405.1
2005/0269277 A1 * 12/2005 Su ..... A47F 7/283 211/74
2009/0308825 A1 * 12/2009 Lin ..... A47B 47/021 211/181.1
2016/0153703 A1 * 6/2016 Jones ..... F25D 25/024 414/807

* cited by examiner

*Primary Examiner* — Jerry-Daryl Fletcher
*Assistant Examiner* — Dario Antonio Deleon
(74) *Attorney, Agent, or Firm* — Sanchelima & Associates, P.A.; Jesus Sanchelima; Christian Sanchelima

(57) ABSTRACT

A deep freezer rack (D.F.R) including a container assembly, a tray assembly, and a rack assembly. A frame from the container assembly is formed by means of hard wires, wherein the frame a shelf and a base therein. The container assembly includes a container holder made of intersecting wires forming a receptacle attached at a lateral side of the frame. The base is made of intersecting wires attached at the bottom of the frame and is configured to receive a receptacle such as a tray or the like. Above the base a shelf is placed, where the shelf is made of intersecting wires to support ice snacks. At the top side of the frame an ice tray is defined where ice trays can be supported, thereby the deep freezer rack provides a well-organized system to store ice products inside a deep freezer.

10 Claims, 4 Drawing Sheets

D.F.R. DEEP FREEZER RACK

BACKGROUND OF THE INVENTION

1. Field of the Invention

The present invention relates to a rack and, more particularly, to a deep freezer rack that includes a rack system with a plurality of compartments to store different liquids products for an easier and quicker freezing inside a deep freezer.

2. Description of the Related Art

Several designs for deep freezer racks have been designed in the past. None of them, however, include a portable rack that includes a plurality of ice tray holders, a beverage bottle compartment and a shelf that holds a plurality of different products freezing or keeping them frozen.

Applicant believes that a related reference corresponds to U.S. Pat. No. 5,626,407 issued for storage system for refrigerators. Applicant believes that another related reference corresponds to U.S. Pat. No. 6,932,449 issued for multi-functional beverage storage rack for a refrigerator. None of these references, however, teach of a portable rack for a freezer comprising an ice tray holder, a beverage bottle holder, and a shelf.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide timesaving means of transforming the temperature of a canned or bottle beverage, snack, frozen treat, ice tray etc.

It is another object of this invention to ensure that a cold or frozen beverage/treat is immediately available when needed.

It is still another object of the present invention to prevent spills and waste of beverages.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
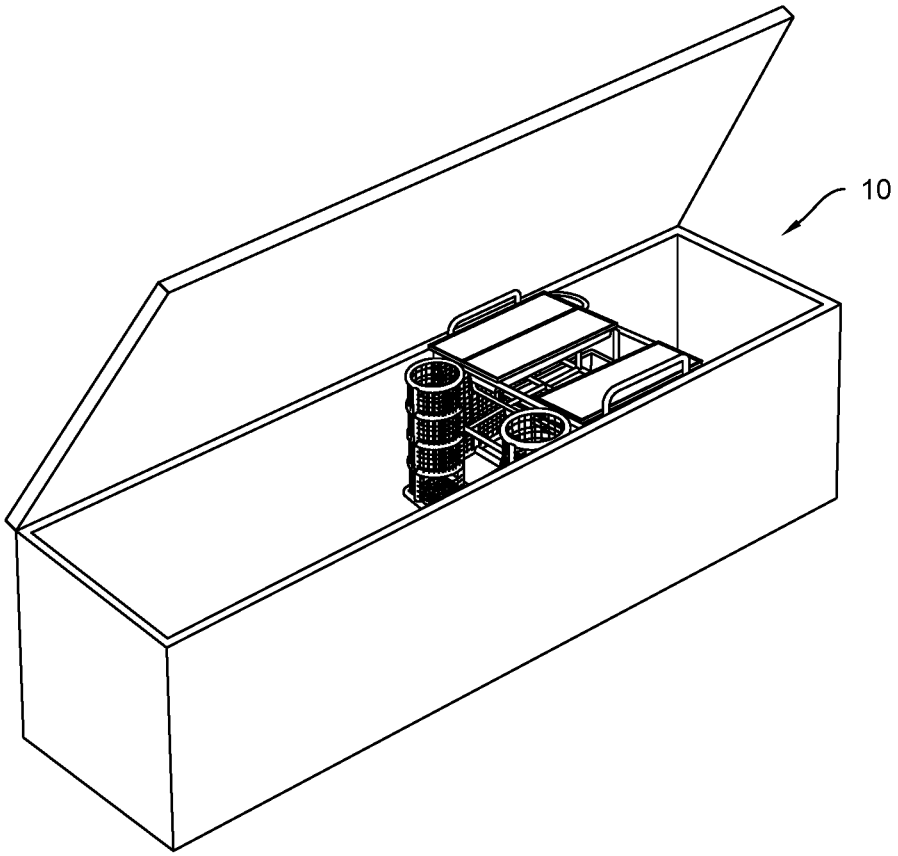
FIG. 1 represents an operational view of an exemplary embodiment of the present invention 10.

Referring now to the drawings, where the present invention is generally referred to with numeral 10, it can be observed that it basically includes a container assembly, 20, trays assembly 40, a rack assembly 60, and various exemplary embodiments (100, 101, 102, 103) thereof. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
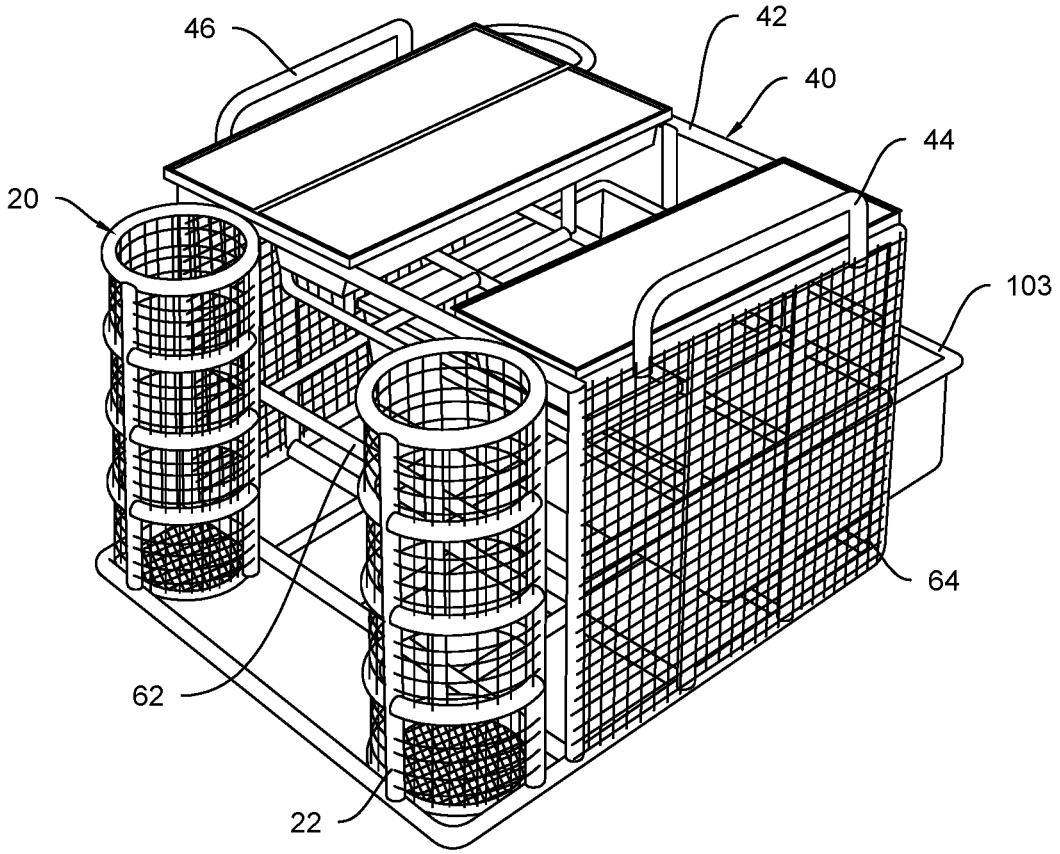
FIG. 2 shows an isometric view of the container assembly 20, trays assembly 40 and rack assembly 60 integrally formed.
Figure 4:
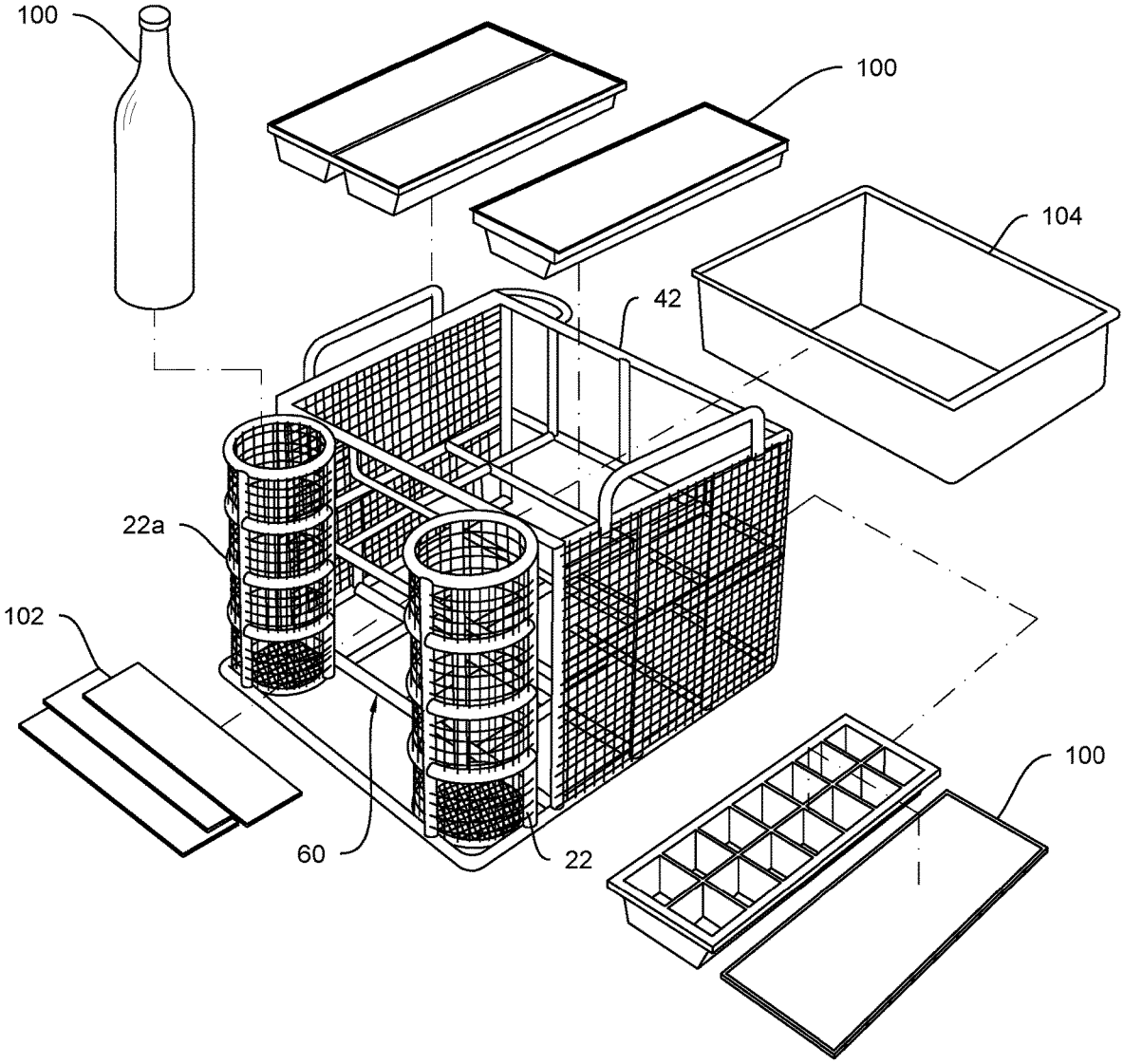
FIG. 4 is a representation of an exploded view of the water container 100, the ice trays 101 and the liquid-based frozen snack with respect to the present invention 10 where they are intended to be stored.

Container assembly 20 includes a container holder 22, a frame 24, and a base 26. In an exemplary embodiment, the frame 24 may be a structural support made of straight and/or curved hard wire, wherein the frame 24 may form a cuboid shape. As FIG. 2 illustrates. In a suitable embodiment, container holder 22 may be a wire shelving made of a series of intersecting straights and curved wires that conforms a cylindrical-shaped container attached at the front side of the frame 24, wherein the container holder 22 includes a bottom made of metal mesh that is configured to support load beams caused by the weight of water container placed therein. As FIG. 4 depicts. In a suitable embodiment, the container holder 22 may have a top opening that conforms with the area of the water container 100, wherein a plurality of container holders 22*a* may be attached to the frame 24. As illustrated in FIG. 4. It should be considered that the frame 24 and the container holder 22 may be made of alloy steel, hard plastic or any other suitable material that supports temperatures under freezing point of water and load beams caused by means of the weight of water container 100 or any other suitable container. In one embodiment, the base 26 may be a wire shelving made of a series of intersecting wires at the bottom side of the frame 24, as FIG. 2 illustrates, wherein the base is configured to receive a receptacle 103, a tray or any other suitable device.

Figure 3:
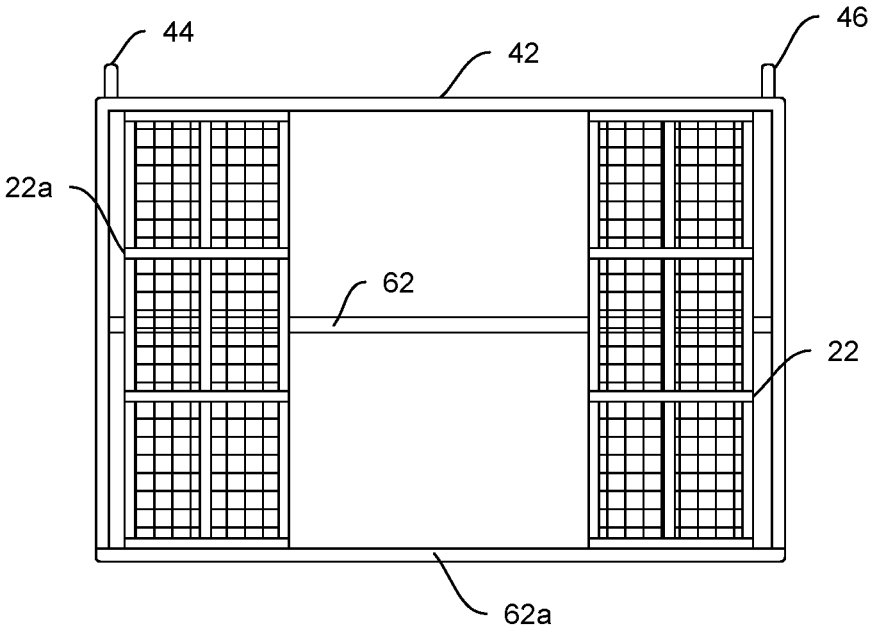
FIG. 3 illustrates a front view of the present invention 10, wherein the container holder may include a plurality thereof 22*a*, and the shelf 62 may be located between the ice tray holder and the base.

Tray assembly 40 includes an ice tray holder 42 and a right arm support 44 and a right support 46. In an exemplary embodiment, the shelf 42 may be formed between a top side of the frame 24 and the base 26, being parallel with respect to the of the container holder 22, wherein the ice tray holder 42, wherein the shelf 42 may be a wire shelving made of a series of intersecting wires attached to internal portion of the frame 24. The ice tray holder 42 may be adapted to hold and support liquid-base frozen snacks 102 or the like. As FIG. 4 illustrates. In a suitable embodiment, the ice tray holder 42 may be made of a metal material, nonetheless, aluminum, alloy steel, hard plastic or any other suitable material should be considered. In a preferred embodiment, the shelf 42 may be attached at the middle portion of the frame's height, as FIG. 3 represents, nonetheless, it should be considered that between the base 26 and the top side of the frame 24 may include a plurality of ice tray holders. In other embodiment, the right arm support 44 may be folded wire attached at the top side of the frame 24, wherein the right arm support 44 may be attached at the top periphery of said frame 24 being parallel with respect to thereof. As FIG. 2 illustrates. In one embodiment, the left arm support 44 may be a folded support attached at an opposite side with respect to the right arm support 44 being parallel with respect to the lateral side of the frame 24, wherein the left arm support 44 may be attached at a top periphery of the frame 24. As FIG. 2 illustrates.

Rack assembly 60 includes an ice tray holder 62 and a grid 64. In an exemplary embodiment, shelf 62 may be formed with respect to the top periphery of the frame 24, wherein the ice tray holder 62 may have a suitable length to receive an ice tray 101 and plurality thereof arranged along the ice tray holder 62. As FIG. 4 represents. In a preferred embodiment, ice tray holder 62 may be made of the same material as the frame 24, wherein the top side of the frame 24 may define said ice tray holder 62. In a suitable embodiment, grid 64 may be made a wire mesh of intersecting parallel wires attached to the lateral sides of the frame 24, wherein said grid 64 is parallel with respect to the left arm support 44 and right arm support respectively, thereby the grid 64 allows the tray or receptacle, and the liquid-base frozen snack to be placed on the base 26 and the shelf by means of the front side and rear side thereof. As FIG. 4 shows.

Referring to the figures of an exemplary embodiment of the present invention 10, and more particularly to FIG. 3, the present invention 10 also referred as DFR may be comprised of a rack system with multiple storage compartments formed into the frame 24 and outside thereof, defining the ice tray holder 62, the shelf 42, and the container holder 22, wherein the right arm support 44 and the left arm support 64 may provide a means to carry and transport the DFR to a deep freezer well known in t art. As shown in FIG. 1. It should be considered that DFR and a plurality thereof may be placed along the recessed portion of the deep freezer providing a means to organize the inventory inside the deep freezer and allowing the liquid-base goods to be frozen and dispensed with ease.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A deep freezer rack, comprising:

a container assembly including a container holder, a wire mesh frame, and a base, wherein said frame has a rectangular cuboid shape with defined length, width, and height dimensions, said container holder has a cylindrical shape that conforms with a shape of a water container, said container holder is attached to a front lateral side of said frame, said container holder comprises a wire shelving made of intersecting wires with a bottom made of metal mesh configured to support load beams, a bottom side of said frame is a wire shelving made of intersecting wires that defines said base;

a tray assembly having a shelf, a right arm support and a left arm support, wherein said shelf is attached inside said frame between a top side of said frame and said base, said shelf is parallel with respect to said base, said right arm support and said left arm support are folded wires attached a top side of the laterals of said frame, being oppositely placed with respect to each other; and a rack assembly including an ice tray holder and a grid, wherein said ice tray holder is defined by a top side of said frame, said grid is a wire mesh of intersecting parallel wires that covers said lateral sides of said frame.

2. The deep freezer rack of claim 1, wherein said container holder is a wire shelving made of intersecting wires.

3. The deep freezer rack of claim 1, wherein said container holder has an opening at a top side thereof.

4. The deep freezer rack of claim 1, wherein said container holder includes a plurality thereof attached to a front side of said frame.

5. The deep freezer rack of claim 1, wherein said frame is made of a hard wire resistant to freezing temperatures and is capable of supporting load-beams caused by means of frozen edible products.

6. The deep freezer rack of claim 1, wherein said shelf is a wire shelving made of intersecting wires attached between said top side of said frame and said base.

7. The deep freezer rack of claim 1, wherein said right arm support and said left arm support are folded wires configured to support a weight of said frame to be carried or transported.

8. The deep freezer rack of claim 1, wherein said grid is a wire mesh of intersecting parallel wires.

9. The deep freezer rack of claim 1, wherein said grid is attached to the lateral sides of said frame, being parallel with respect to said right arm support and said let arm support respectively.

10. A deep freezer rack, consisting of:

a) container assembly including a container holder, a frame, and a base, wherein said frame has a rectangular cuboid shape with defined structural dimensions, said container holder has a cylindrical shape that conforms with a shape of a water container, said container holder is attached to a lateral side of said frame, a bottom side of said frame is a wire shelving made of intersecting wires that defines said base, said container holder is a wire shelving made of intersecting wires, said container holder has an opening at a top side thereof, said container holder includes a plurality thereof attached to a front side of said frame, wherein said frame is made of a metal wire material resistant to freezing temperatures and is capable of supporting load-beams caused by means of frozen edible products;

b) a tray assembly having a shelf, a right arm support and a left arm support, wherein said shelf is attached inside said frame, said shelf is parallel with respect to said base, said right arm support and said left arm support are wires attached a top side of the laterals of said frame, being oppositely placed with respect to each other, wherein said shelf of said tray assembly is a wire shelving made of intersecting wires attached between said top side of said frame and said base, said right arm support and said left arm support are folded wires configured to support a weight of said frame to be carried or transported; and c) a rack assembly including an ice tray holder and a grid, wherein said ice tray holder is defined by a top side of said frame, said grid is a cover for said lateral sides of said frame, said grid is a wire mesh of intersecting parallel wires, said grid is attached to the lateral sides of said frame, being parallel with respect to said right arm support and said let arm support respectively.

* * * * *